US009429277B2

(12) United States Patent
Pearson et al.

(10) Patent No.: US 9,429,277 B2
(45) **Date of Patent: *Aug. 30, 2016**

(54) STRINGED LED CAPSULE LIGHTING APPARATUS

(71) Applicant: Tempo Industries, LLC, Irvine, CA (US)

(72) Inventors: Dennis Pearson, Foothill Ranch, CA (US); Guang Jin, Santa Monica, CA (US); Jorge Santana, Irvine, CA (US)

(73) Assignee: Tempo Industries, LLC, Irvine, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/312,311

(22) Filed: Jun. 23, 2014

(65) Prior Publication Data

US 2014/0328057 A1 Nov. 6, 2014

Related U.S. Application Data

(63) Continuation of application No. 13/533,833, filed on Jun. 26, 2012, now Pat. No. 8,794,817.

(60) Provisional application No. 61/637,141, filed on Apr. 23, 2012.

(51) Int. Cl.

| | |
|---|---|
| ***F21K 99/00*** | (2016.01) |
| ***F21V 5/04*** | (2006.01) |
| ***F21V 21/088*** | (2006.01) |
| ***F21V 15/01*** | (2006.01) |
| ***F21V 17/16*** | (2006.01) |
| ***F21V 21/34*** | (2006.01) |
| *F21V 27/02* | (2006.01) |
| *F21Y 101/02* | (2006.01) |

(52) U.S. Cl.

CPC . *F21K 9/10* (2013.01); *F21V 5/04* (2013.01); *F21V 15/01* (2013.01); *F21V 17/164* (2013.01); *F21V 21/088* (2013.01); *F21V 21/34* (2013.01); *F21V 27/02* (2013.01); *F21Y 2101/02* (2013.01)

(58) Field of Classification Search

CPC ..... F21K 9/10; F21V 5/04

See application file for complete search history.

(56) References Cited

U.S. PATENT DOCUMENTS

| | | | | |
|---|---|---|---|---|
| 6,648,492 | B1 * | 11/2003 | Shih | 362/397 |
| 7,036,962 | B2 * | 5/2006 | Chan | 362/407 |
| 7,210,957 | B2 * | 5/2007 | Mrakovich | 439/404 |
| 2003/0218879 | A1 * | 11/2003 | Tieszen | 362/235 |
| 2005/0185400 | A1 * | 8/2005 | Hsu | 362/238 |
| 2006/0087851 | A1 * | 4/2006 | Dubord | 362/362 |
| 2011/0194292 | A1 * | 8/2011 | Tsai | 362/311.02 |

* cited by examiner

*Primary Examiner* — Elmito Breval

(74) *Attorney, Agent, or Firm* — Lapple Ubell IP Law LLP; Franklin Ubell

(57) ABSTRACT

A plurality of adjacent capsules, each comprising a base component, a body component carrying an LED circuit board, and a lens component, wherein the body and the base snap together and the lens snap-fits to the body. Such capsules are attached to a flexible electrical power cable by electrical connector components internal to the body and which conduct power from the power cable through the body to the LED circuit board.

31 Claims, 9 Drawing Sheets

STRINGED LED CAPSULE LIGHTING APPARATUS

CROSS REFERENCE TO RELATED APPLICATIONS

This application is a continuation of U.S. utility patent application Ser. No. 13/533,833, filed Jun. 26, 2012, entitled "Stringed LED Capsule Lighting Apparatus", and claims the benefit of and priority to U.S. Provisional Application Ser. No. 61/637,141, filed Apr. 23, 2012, entitled "Modular LED Lighting Apparatus," the contents of each of which are hereby incorporated herein by reference in their entirety.

BACKGROUND

1. Field

The subject disclosure relates to LED lighting apparatus and more particularly to such apparatus providing a string of LED circuit board carrying capsules.

2. Related Art

Various decorative and/or accent linear lighting apparatus such as rope light, luminous incandescent lighting, and festoon lighting have been in use for some time.

SUMMARY

An illustrative stringed LED capsule lighting apparatus comprises a plurality of adjacent capsules, each capsule comprising (a) a base component, (b) a body component carrying an LED circuit board thereon, and (c) a lens component, wherein, in one embodiment, the body and the base snap together and the lens snap-fits to the body. Electrical conductors for supplying power to the LEDs enter at one end of the body and exit at an opposite end of the body and attach to respective internal metal connector components, which pass through a surface of the body to supply power to one or more LEDs. The electrical connector components may attach to the body, for example, by snapping into the body in an interior portion thereof to thereby hook the capsules to the conductors, thereby forming a flexible string of LED light capsules. In one embodiment, a guide track and means on the capsule bodies for attaching the capsules to the guide track are provided.

DETAILED DESCRIPTION

Figure 1:
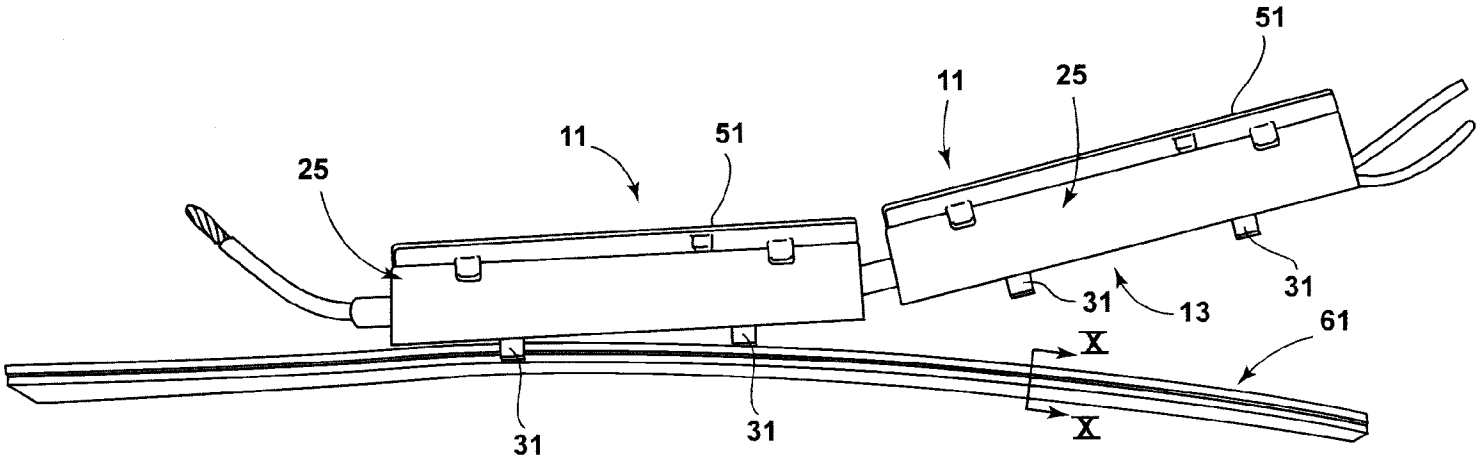
FIG. 1 is a side view illustrating a plurality of LED light capsules and a guide track which may find use therewith.

FIG. 1 shows an illustrative embodiment of a string of LED light modules or "capsules" 11 and a flexible guide track 61 to which the capsules 11 may attach. According to an illustrative embodiment, each LED light capsule 11 comprises a base 13, a body 25, and a lens 51, all three of which may snap together to form the unit 11.

Figure 2:
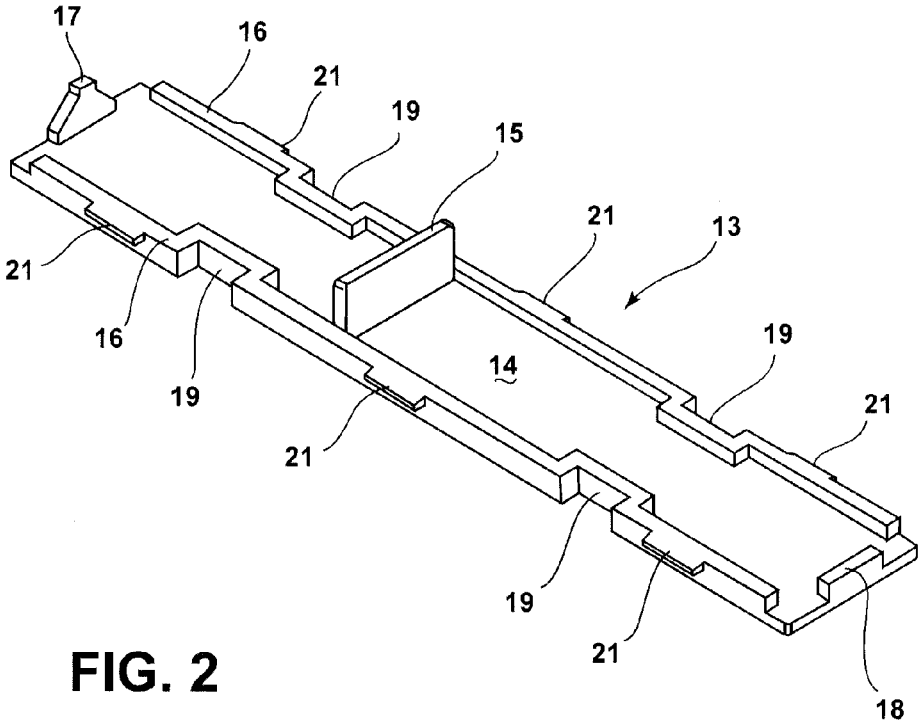
FIG. 2 is a perspective view of a base component of a light capsule.
Figure 3:
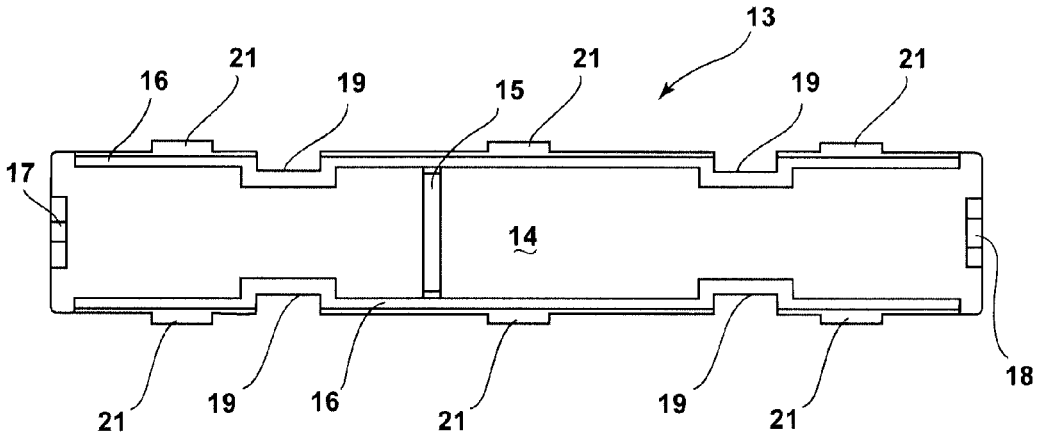
FIG. 3 is a top view of the base component of FIG. 2.
Figure 4:
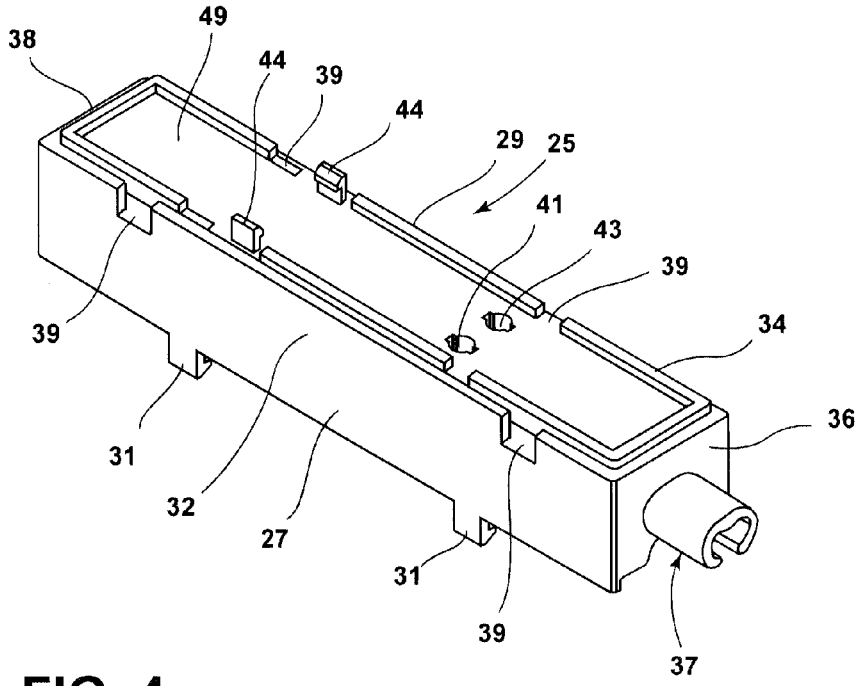
FIG. 4 is a perspective view of a body component of a light capsule.
Figure 7:
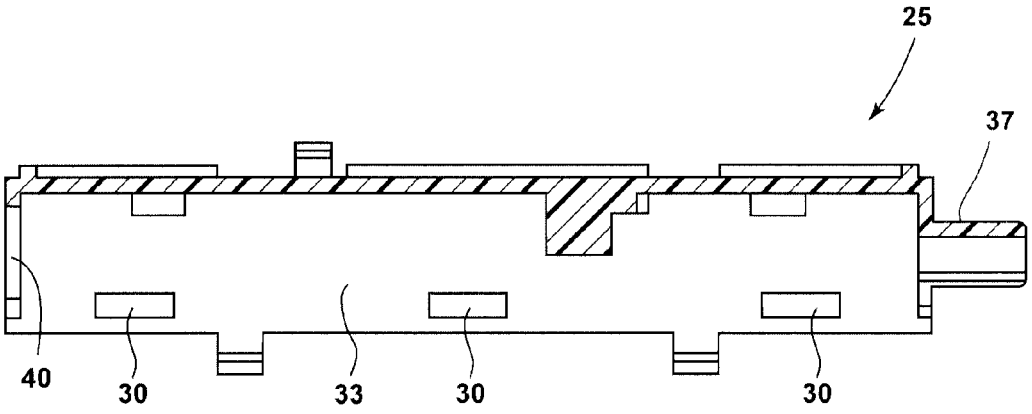
FIG. 7 is a sectional view taken at VII-VII of FIG. 5.

A base member 13 is shown in FIGS. 2-3 and includes a generally flat floor portion 14 from which extends a generally rectangular inner vertical support 15 and respective end supports 17, 18. Along each side of the floor 14 are respective vertical lips 16, indentations 19 in the vertical lips 16, and mounting tabs 21. The indentations 19 allow passage of guide track mounting tabs 31 of the body 25, while the tabs 21 snap into recesses 30 (FIG. 7) in the inner sidewalls 33, 35 of the body 25 to enable the base 13 to snap or press fit to the body 25.

Figure 8:
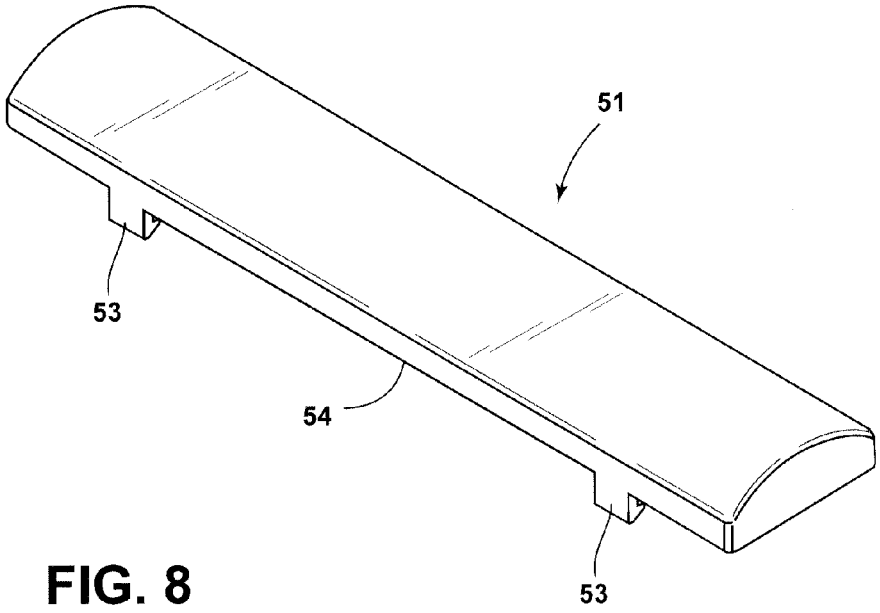
FIG. 8 is a perspective view of a lens component.
Figure 9:
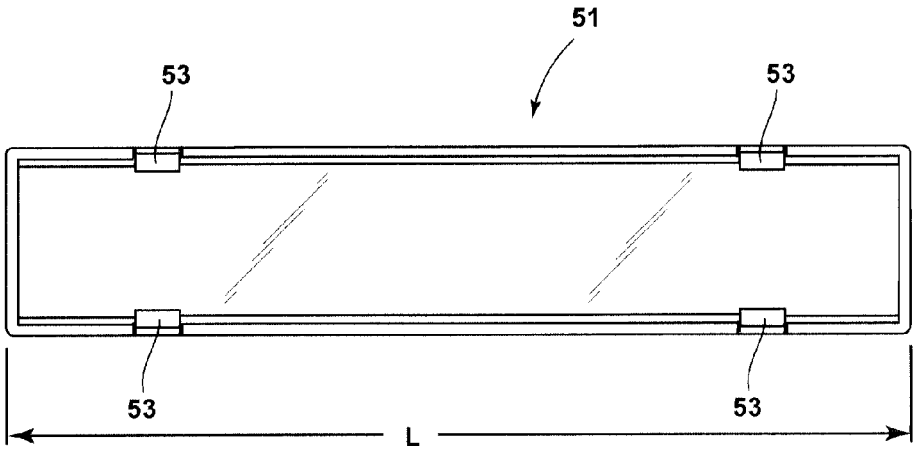
FIG. 9 is a bottom view of the lens component of FIG. 8.

FIGS. 4-7 further show that the body 25 includes vertical side walls 32,34 and front and back walls, 36. 38. A wire guide 37 protrudes from the front wall 36, while an oval opening 40 (FIG. 12) is formed in the back wall 38. The guide track mounting tabs 31 are formed along the bottom edges of the side walls 32, 34, while slots 39 are formed along the top edges. The slots 39 accommodate tabs 53 formed on respective sides of the lower rectangular edge 54 of the lens 51 (FIG. 8) and facilitate snap fitting of the lens 51 onto the body 25. Flexible fingers 44 extend from a top surface 48 of the body 25 and serve to attach an LED-carrying circuit board 115 (FIG. 11) to the surface 48.

Figure 5:
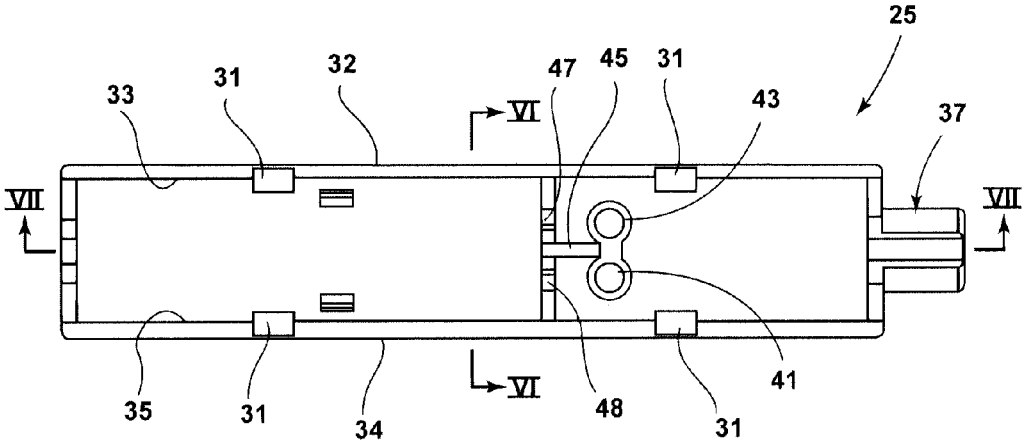
FIG. 5 is a top view of the body component of FIG. 4.
Figure 6:
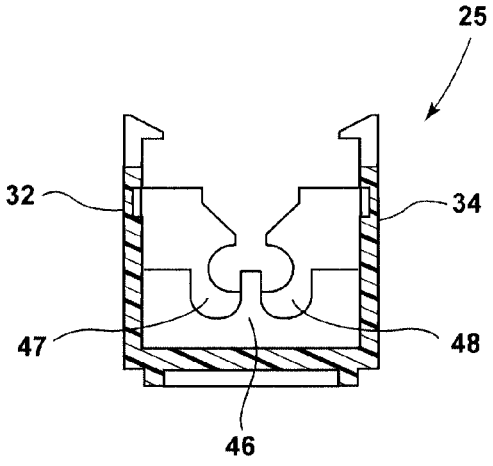
FIG. 6 is a sectional view taken at VI-VI of FIG. 5.

A pair of holes 41, 43 are provided through the top surface 48 of body 25 and facilitate passage of electrical pins 109, 111 (FIG. 11) to supply power to the LEDs, e.g., 112 and related circuitry on the LED carrying circuit board 115. In one embodiment, one or more relatively low power LEDs are employed to achieve various decorative lighting effects. As shown in FIGS. 5 and 6, wire guides are formed on the underside of surface 49, which in the illustrative embodiment include a central vertical guide tab 45 and a horizontal tab 46 with wire guide slots 47 and 48.

Figure 11:
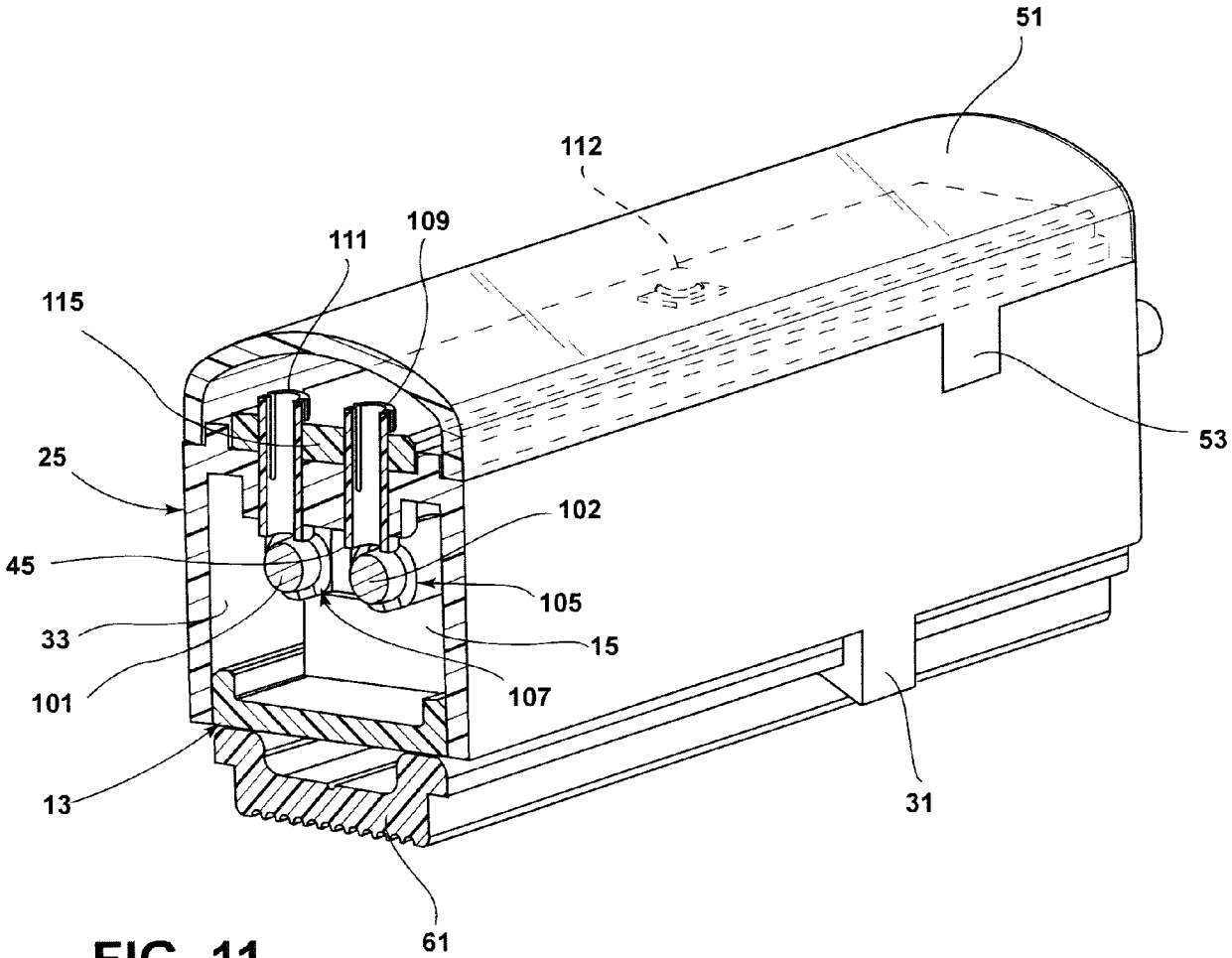
FIG. 11 is a cutaway view of a portion of a light capsule unit illustrating internal electrical conducting componentry.
Figure 12:
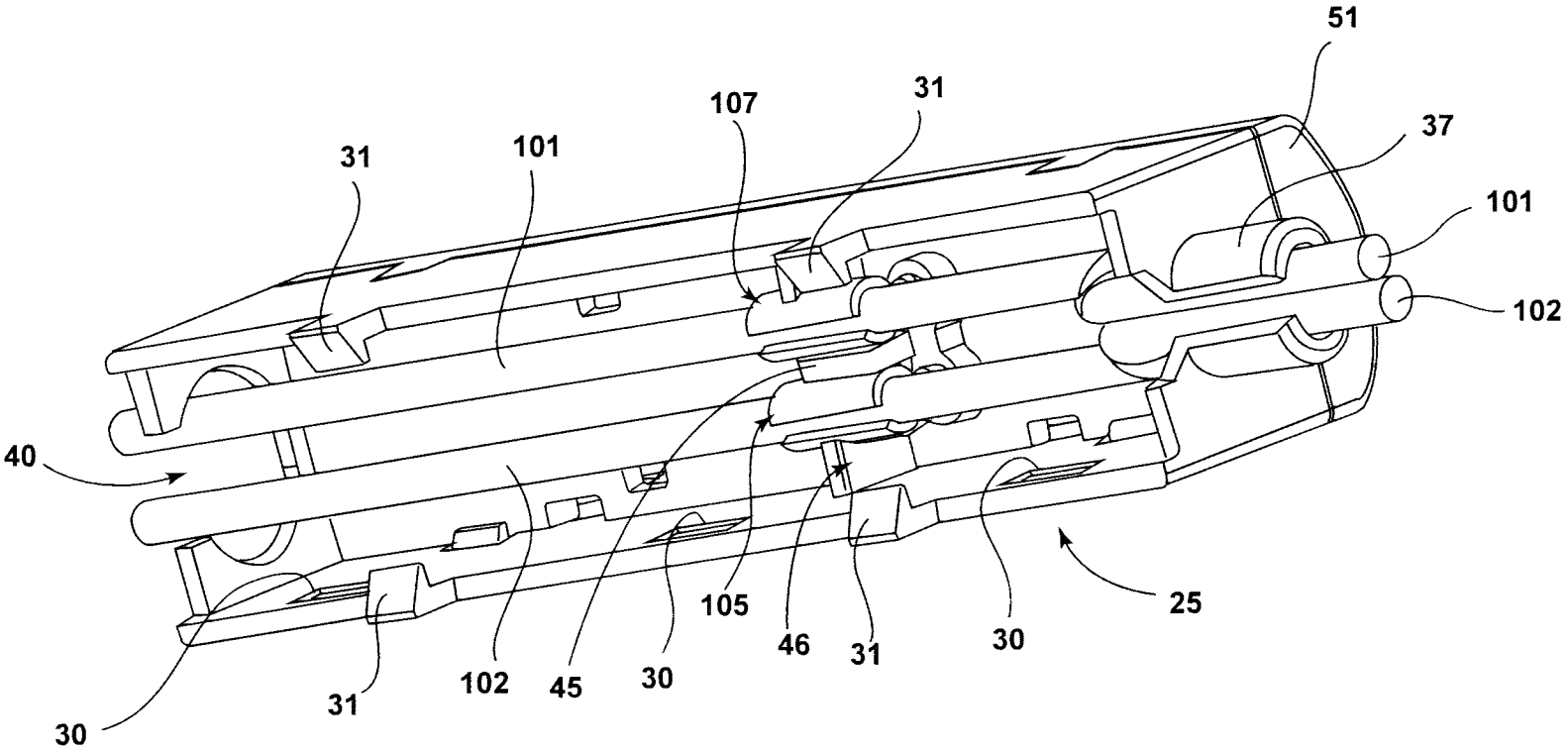
FIG. 12 is a perspective view of the underside of a light capsule unit with the base component removed.
Figure 13:
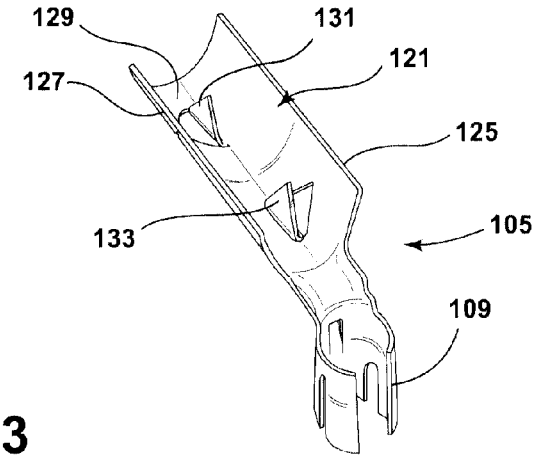
FIG. 13 is a perspective view of an illustrative embodiment of an electrical connector.
Figure 14:
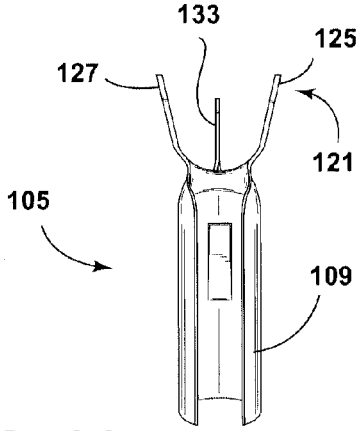
FIG. 14 is an end view of the connector of FIG. 13.
Figure 15:
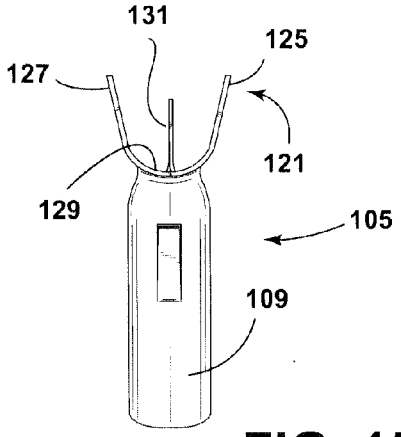
FIG. 15 is an end view of an opposite end of the connector of FIG. 13.
Figure 16:
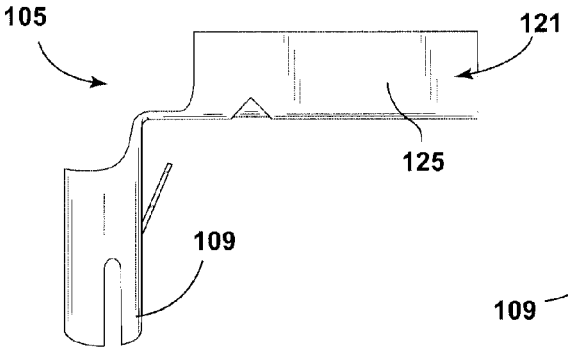
FIG. 16 is a side view of the connector of FIG. 13.
Figure 17:
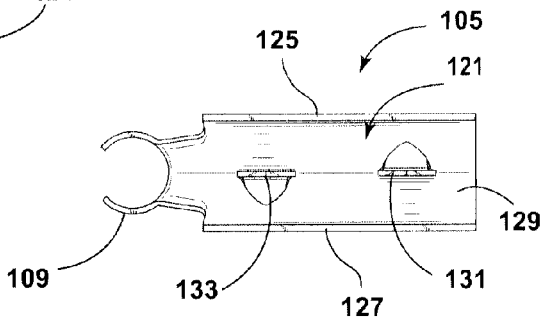
FIG. 17 is a side view of the connector of FIG. 13.

FIGS. 11 and 12 illustrate how the respective electrical conductors (wires) 101,102 are guided through the body and employed to interconnect one adjacent module or capsule 11 to the next. In particular, in one illustrative embodiment, metal connector components 105, 107 are clamped onto the respective wires 101, 102 so as to pierce and make electrical contact with the current carrying electrical conductors inside respective outer insulative layers of the wires 101,102. Additionally, the wire guides 37 capture and hold the electrical cable to further assist in attaching the capsules 11 to the cable.

Figure 10:
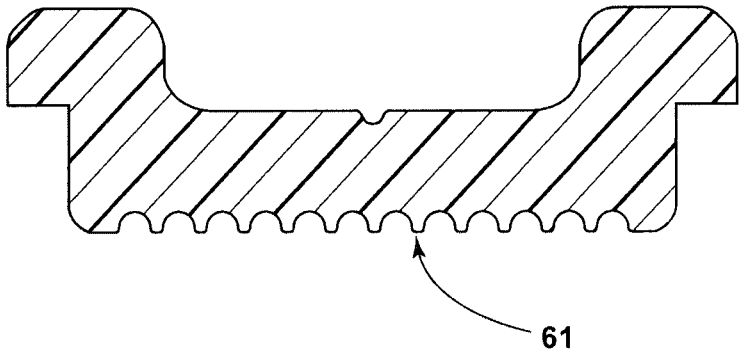
FIG. 10 is a sectional view of an illustrative guide track taken at X-X of FIG. 1.

As noted above, the connector components 105, 107 include the vertically extending pins 109, 111, which carry power to the circuit board 115. As may be seen in FIG. 12, respective cylindrical portions of the connector components 105, 107 snap into or otherwise attach to the respective wire guide slots 47, 48 and are separated by the central vertical guide tab 45. The conductors 101, 102 are guided out of the body 25 at one end by the wire guide 37, which, in an illustrative embodiment, extends into the oval opening 40 of an adjacent capsule 11 and is shaped and sized to be pivotable or rotatable therein to guide and shield the conductors 101,102, while at the same time allowing each module or capsule 11 in a string of modules or capsules to freely bend in any direction and to provide decorative "string lighting" effects. In one embodiment, strings of modules can be removably attached to a guide track 61, which may be stapled to adjacent surfaces and optionally also glued, employing the teeth on the underside of the guide track (FIG. 10) which serve to provide more surface area to promote adhesion. The flexibility of the guide track 61 may also vary in various embodiments.

An illustrative embodiment of a connector 105 is shown in more detail in FIGS. 13-17. The connector 105 includes a horizontal channel 121 which unitarily forms or bends into a vertically disposed pin 109. The channel 121 includes respective sides 125, 127, which extend on either side of an arcuate bottom portion 129. First and second teeth 131, 133 protrude upwardly from the bottom portion 129. In one embodiment, the second connector 107 may be identical to connector 105. Connectors so constructed may be readily attached to insulated electrical conductors or cable utilizing a machine which pushes the teeth 131, 133 through the insulation and into the electrically conductive portion as the sides 125, 127 are crimped around the cable.

Various embodiments may provide low-profile (¾" H×⅝" W), dimmable high-performance, LED articulated accent lighting and may employ Class I or Class II low voltage (12V) transformers. Illustrative embodiments may further comprise a series of low-voltage LED capsules directly attached to a flexible wire harness. Such embodiments can conform to a radius as small as six-inches, allowing attachment to inside and outside curves in a multitude of interior and exterior applications, and in one embodiment, employing lighting-class LEDs, of, for example, 40 to 80 milliamps with 3 LEDs per board 115. Runs of 30 feet, and optionally 60 feet, are available according to various embodiments. In one embodiment, the length "L" of the lens 51, may be 3.0 inches, but of course may vary in other embodiments.

Those skilled in the art will appreciate that various adaptations and modifications of the just described illustrative embodiments can be configured without departing from the scope and spirit of the invention. Therefore, it is to be understood that, within the scope of the appended claims, the invention may be practiced other than as specifically described herein.

What is claimed is:

1. The lighting apparatus comprising:

a plurality of adjacent capsules each comprising:

a base;

a body carrying a circuit board thereon, each circuit board carrying one or more LEDs; and a lens;

a plurality of electrical conductors;

wherein the body and the base of each respective capsule removably attach together and wherein the lens of each capsule removably attaches to its respective body; and wherein each capsule is attached to the plurality of electrical conductors.

2. The apparatus of claim 1 wherein said plurality of electrical conductors enter at one side of a said capsule and exit at the other side.

3. The lighting apparatus of claim 2 wherein said plurality of electrical conductors comprise a first wire and a second wire, wherein the first and second wires enter a first body of a first capsule, pass through the first body, and exit the first body and wherein the first and second wires then enter a second body of a second capsule, pass through the second body and exit the second body.

4. The apparatus of claim 1 further comprising a guide track and further including means for attaching each of a plurality of said capsules to the guide track.

5. The apparatus of claim 1 further comprising a guide track and wherein said guide track and a plurality of said capsules are configured to attach together.

6. The apparatus of claim 5 wherein the attachment between said guide track and said plurality of said capsules is a removable attachment.

7. The apparatus of claim 1 wherein the base of each respective capsule lies below the body of that capsule.

8. The apparatus of claim 7 wherein each respective lens has a rectangular lower edge and wherein the body removably attached to each respective lens comprises a plurality of slots which accommodate respective tabs formed on said lower rectangular edge, which tabs are shaped to snap-fittingly attach each lens to its respective body.

9. The apparatus of claim 7 wherein each said base comprises a generally rectangular perimeter with a plurality of indentations therein.

10. The apparatus of claim 9 wherein each respective lens has a rectangular lower edge and wherein the body removably attached to each respective lens comprises a plurality of slots which accommodate respective tabs formed on said lower rectangular edge, which tabs are shaped to snap-fittingly attach each lens to its respective body.

11. The apparatus of claim 1 wherein the base of each respective capsule comprises a generally rectangular perimeter with a plurality of indentations therein.

12. The apparatus of claim 11 wherein each respective lens has a rectangular lower edge and wherein the body removably attached to each respective lens comprises a plurality of slots which accommodate respective tabs formed on said lower rectangular edge, which tabs are shaped to snap-fittingly attach each lens to its respective body.

13. The apparatus of claim 1 wherein each respective lens has a rectangular lower edge and wherein the body removably attached to each respective lens comprises a plurality of slots which accommodate respective tabs formed on said lower rectangular edge, which tabs are shaped to snap-fittingly attach each lens to its respective body.

14. The apparatus of claim 1 further comprising a guide track and wherein each of said plurality of capsules has a plurality of depending tabs shaped to attach each capsule to said guide track.

15. The apparatus of claim 14 wherein each respective lens has a rectangular lower edge having a plurality of tabs formed thereon and wherein the body removably attached to each respective lens comprises a plurality of slots which accommodate the respective tabs, which tabs are shaped to snap-fittingly attach each lens to its respective body.

16. The apparatus of claim 14 wherein said base comprises a generally rectangular perimeter with a plurality of indentations therein.

17. The lighting apparatus comprising:

a plurality of adjacent capsules each comprising:

a base;

a body carrying a circuit board thereon, each circuit board carrying one or more LEDs; and a lens;

a plurality of electrical conductors; and wherein the body and the base of each respective capsule removably attach together and wherein the lens of each capsule removably attaches to its respective body.

18. The lighting apparatus of claim 17 wherein each capsule is fixed in position with respect to the plurality of electrical conductors.

19. The apparatus of claim 17 wherein said plurality of electrical conductors enter at one side of a said capsule and exit at the other side.

20. The lighting apparatus of claim 17 wherein said plurality of electrical conductors comprise a first wire and a second wire, wherein the first and second wires enter a first body of a first capsule, pass through the first body, and exit the first body and wherein the first and second wires then enter a second body of a second capsule, pass through the second body and exit the second body.

21. The apparatus of claim 18 wherein said plurality of electrical conductors enter at one side of a said capsule and exit at the other side.

22. The lighting apparatus of claim 18 wherein said plurality of electrical conductors comprise a first wire and a second wire, wherein the first and second wires enter a first body of a first capsule, pass through the first body, and exit the first body and wherein the first and second wires then enter a second body of a second capsule, pass through the second body and exist the second body.

23. The apparatus of claim 17 further comprising a guide track and further including means for attaching each of a plurality of said capsules to the guide track.

24. The apparatus of claim 17 further comprising a guide track and wherein said guide track and a plurality of said capsules are configured to attach together.

25. The apparatus of claim 24 wherein the attachment between said guide track and said plurality of said capsules is a removable attachment.

26. The apparatus of claim 17 wherein the base of each respective capsule lies below the body of that capsule.

27. The apparatus of claim 26 wherein each respective lens has a rectangular lower edge having a plurality of tabs formed thereon and wherein the body removably attached to each respective lens comprises a plurality of slots which accommodate the respective tabs, which tabs are shaped to snap-fittingly attach each lens to its respective body.

28. The apparatus of claim 27 wherein each respective lens has a rectangular lower edge having a plurality of tabs formed thereon and wherein the body removably attached to each respective lens comprises a plurality of slots which accommodate the respective tabs, which tabs are shaped to snap-fittingly attach each lens to its respective body.

29. The apparatus of claim 17 wherein each said base comprises a generally rectangular perimeter with a plurality of indentations therein.

30. The apparatus of claim 17 wherein each respective lens has a rectangular lower edge having a plurality of tabs formed thereon and wherein the body removably attached to each respective lens comprises a plurality of slots which accommodate the respective tabs, which tabs are shaped to snap-fittingly attach each lens to its respective body.

31. The apparatus of claim 17 further comprising a guide track and wherein each of said plurality of capsules has a plurality of depending tabs shaped to attach each capsule to said guide track.

* * * * *